US010251455B2

(12) United States Patent
Peng et al.

(10) Patent No.: US 10,251,455 B2
(45) Date of Patent: Apr. 9, 2019

(54) SQUARE FOR ZIPPER AND ZIPPER

(71) Applicant: Zhejiang Weixing Industrial Development Co. Ltd., Linhai Taizhou, Zhejiang (CN)

(72) Inventors: Guifei Peng, Linhai Taizhou (CN); Bo Qu, Linhai Taizhou (CN)

(73) Assignee: ZHEJIANG WEIXING INDUSTRIAL DEVELOPMENT CO., LTD., Zhejiang (CN)

( * ) Notice: Subject to any disclaimer, the term of this patent is extended or adjusted under 35 U.S.C. 154(b) by 153 days.

(21) Appl. No.: 14/906,754

(22) PCT Filed: Dec. 6, 2013

(86) PCT No.: PCT/CN2013/088794

§ 371 (c)(1),
(2) Date: Jan. 21, 2016

(87) PCT Pub. No.: WO2015/010414

PCT Pub. Date: Jan. 29, 2015

(65) Prior Publication Data

US 2016/0157567 A1 Jun. 9, 2016

(30) Foreign Application Priority Data

Jul. 25, 2013 (CN) ..... 2013 1 0319434
Jul. 25, 2013 (CN) ..... 2013 2 0452378 U

(51) Int. Cl.
*A44B 19/36* (2006.01)
*A44B 19/38* (2006.01)

(52) U.S. Cl.
CPC ..... *A44B 19/36* (2013.01); *A44B 19/38* (2013.01)

(58) Field of Classification Search
CPC ..... A44B 19/36; A44B 19/38
See application file for complete search history.

(56) References Cited

U.S. PATENT DOCUMENTS 1,960,202 A * 5/1934 Carr ..... A44B 19/36 24/436
1,966,963 A * 7/1934 Jordan ..... A44B 19/36 24/387

(Continued)

FOREIGN PATENT DOCUMENTS

CH 271097 A 10/1950
CN 2456514 Y 10/2001

(Continued)

OTHER PUBLICATIONS

Chinese Office Action dated Apr. 26, 2016 for Chinese Application No. 201310319434.3.

(Continued)

*Primary Examiner* — Robert Sandy
*Assistant Examiner* — Louis A Mercado
(74) *Attorney, Agent, or Firm* — Maschoff Brennan

(57) ABSTRACT

A zipper includes a left zipper belt, a right zipper belt, and a square slider. Each of the left zipper belt and the right zipper belt is provided with a left stop member and a right stop member. The slider includes an upper fin, a lower fin, and a connection support rod. Two sides of the slider are separately provided with a first inserting opening and a second inserting opening fitting correspondingly to the left stop member and the right stop member.

4 Claims, 6 Drawing Sheets

(56) References Cited

U.S. PATENT DOCUMENTS

| | | | | |
|---|---|---|---|---|
| 2,044,161 | A * | 6/1936 | Forster | A44B 19/36 24/436 |
| 2,112,725 | A * | 3/1938 | Carlile | A44B 19/36 24/388 |
| 2,161,329 | A * | 6/1939 | Wittenberg | A44B 19/36 24/436 |
| 2,701,401 | A * | 2/1955 | Dorman | A44B 19/36 24/404 |
| 2,932,872 | A * | 4/1960 | Geissmann | A44B 19/301 24/388 |
| 6,131,250 | A * | 10/2000 | Fan | A44B 19/388 24/432 |
| 6,195,852 | B1 | 3/2001 | Kusayama | |
| 7,340,806 | B2 * | 3/2008 | Matsumoto | A44B 19/38 24/433 |
| 2004/0020018 | A1 * | 2/2004 | Tsaur | A44B 19/36 24/436 |
| 2005/0060848 | A1 * | 3/2005 | Tsaur | A44B 19/36 24/436 |
| 2007/0067969 | A1 * | 3/2007 | Kusayama | A44B 19/32 24/436 |
| 2008/0092347 | A1 | 4/2008 | Ogura | |
| 2012/0017403 | A1 * | 1/2012 | Chang | A44B 19/36 24/436 |
| 2014/0201958 | A1 * | 7/2014 | Huang | A44B 19/36 24/435 |
| 2016/0157567 | A1 * | 6/2016 | Peng | A44B 19/36 24/388 |

FOREIGN PATENT DOCUMENTS

| | | | | |
|---|---|---|---|---|
| CN | 201436887 | | 4/2010 | |
| CN | 201938539 | | 8/2011 | |
| CN | 203388367 | U | 1/2014 | |
| DE | 141612 | | 5/1980 | |
| WO | WO-2012164682 | A1 * | 12/2012 | A44B 19/38 |

OTHER PUBLICATIONS

International Search Report dated Mar. 4, 2014 for Application No. PCT/CN2013/0088794 filed Jun. 12, 2013.

* cited by examiner

SQUARE FOR ZIPPER AND ZIPPER

CROSS-REFERENCE TO RELATED APPLICATIONS

This application is the national phase of International Application No. PCT/CN2013/088794, titled "SQUARE FOR ZIPPER AND ZIPPER", filed on Dec. 6, 2013, which claims the benefit of priorities to Chinese Patent Applications No. 201310319434.3 titled "RETAINING BOX FOR ZIPPER AND ZIPPER", filed with the Chinese State Intellectual Property Office on Jul. 25, 2013, and No. 201320452378.6 titled "RETAINING BOX FOR ZIPPER AND ZIPPER", filed with the Chinese State Intellectual Property Office on Jul. 25, 2013, the entire disclosures of the applications are incorporated herein by reference.

FIELD

The present application relates to the technical field of zippers, and more particularly to a retaining box for a zipper, and a zipper.

BACKGROUND

A zipper consists of zipper teeth, a slider, a top stop, a bottom stop or a fastener, etc. The zipper teeth are a critical part, which directly determines a side pull strength of the zipper. A common zipper has two zipper tapes, and each zipper tape has a row of zipper teeth, and two rows of zipper teeth are arranged to be staggered with each other. The slider clamps the zipper teeth at both sides, and slides by means of a pull tab, thus enabling the zipper teeth at both sides to be engaged with or disengaged from each other.

Presently zippers generally include a double-separating zipper and a single-separating zipper. The double-separating zipper refers to a zipper having two sliders in cooperation with the zipper teeth. Specifically, the two sliders respectively achieve objects of locking when being pulled upwards and locking when being pulled downwards, i.e., when the two sliders respectively slide in directions away from each other, the zipper is locked, and when the two sliders respectively slide in directions towards each other, the zipper is unlocked.

The single-separating zipper refers to a zipper having one slider in cooperation with the zipper. Specifically, in addition to the slider, a retaining box is further included, and the retaining box is fixed to one of the two sides and cannot slide upwards and downwards.

Hence, a technical issue to be addressed by those skilled the art is to allow the retaining box to slide upwards and downwards.

SUMMARY

In view of this, an object of the present application is to provide a retaining box for a zipper to allow the retaining box to slide upwards and downwards.

Another object of the present application is to provide a zipper having the above retaining box for the zipper.

In order to achieve the above objects, the following technical solutions are provided according to the present application.

A retaining box for a zipper, includes:

an upper panel;

a lower panel arranged oppositely to the upper panel; and a connecting brace configured to connect the upper panel and the lower panel, a first insertion opening in cooperation with a left stop and a right stop is provided at one end away from the connecting brace of the upper panel and one end away from the connecting brace the lower panel, and a second insertion opening in cooperation with the left stop and the right stop is provided at another end of the upper panel and another end of the lower panel, and the connecting brace divides the second insertion opening into a left insertion opening in cooperation with the left stop and a right insertion opening in cooperation with the right stop.

Preferably, one end facing towards the first insertion opening, of the connecting brace has a cross-sectional width smaller than a cross-sectional width of another end of the connecting brace.

A zipper, includes a left zipper tape, a right zipper tape, and a slider in cooperation with the left zipper tape and the right zipper tape, wherein the left zipper tape is provided with a left stop, and the right zipper tape is provided with a right stop, wherein the slider is the retaining box for a zipper according to the above descriptions.

Preferably, in the zipper, the left stop has a cap end at the top configured to close the right insertion opening and the left insertion opening.

Preferably, in the zipper, the lower panel is provided with a position-limiting groove in cooperation with a position-limiting protrusion of the cap end.

Preferably, in the zipper, the cap end has a shape fitting a shape of an outer side edge of an opening end of the second insertion opening.

Preferably, in the zipper, a surface of the left stop facing towards the right stop is provided with a first mating member; and a surface of the right stop facing towards the left stop is provided with a second mating member mated with the first mating member in a concave and convex form.

Preferably, in the above zipper, the first mating member is a convex, and the second mating member a concave.

According to the above technical solutions, the retaining box for the zipper according to the present application is designed to have the upper panel and the lower panel and have the connecting brace between the upper panel and the low panel, thus the retaining box for the zipper according to the present application is designed to have the functions of a slider, meanwhile, still have the effects of a retaining box in appearance. Hence, the retaining box for the zipper according to the present application has the functions of the slider and the appearance effects of the retaining box, and the retaining box is slidable upwards and downwards along the zipper tapes. In the case that the retaining box for the zipper is used in the zipper, in addition to achieving the effects of a double-separating zipper, the zipper may be used as a single-separating zipper when the retaining box is not pulled.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are only some examples of the present application, and for the person skilled in the art, other drawings may be obtained based on these drawings without any creative efforts.

DETAILED DESCRIPTION

An object of the present application is to provide a retaining box for a zipper and a zipper, to enable the retaining box to slide upwards and downwards and have the function of a slider.

The technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the scope of the present application.

Figure 1:
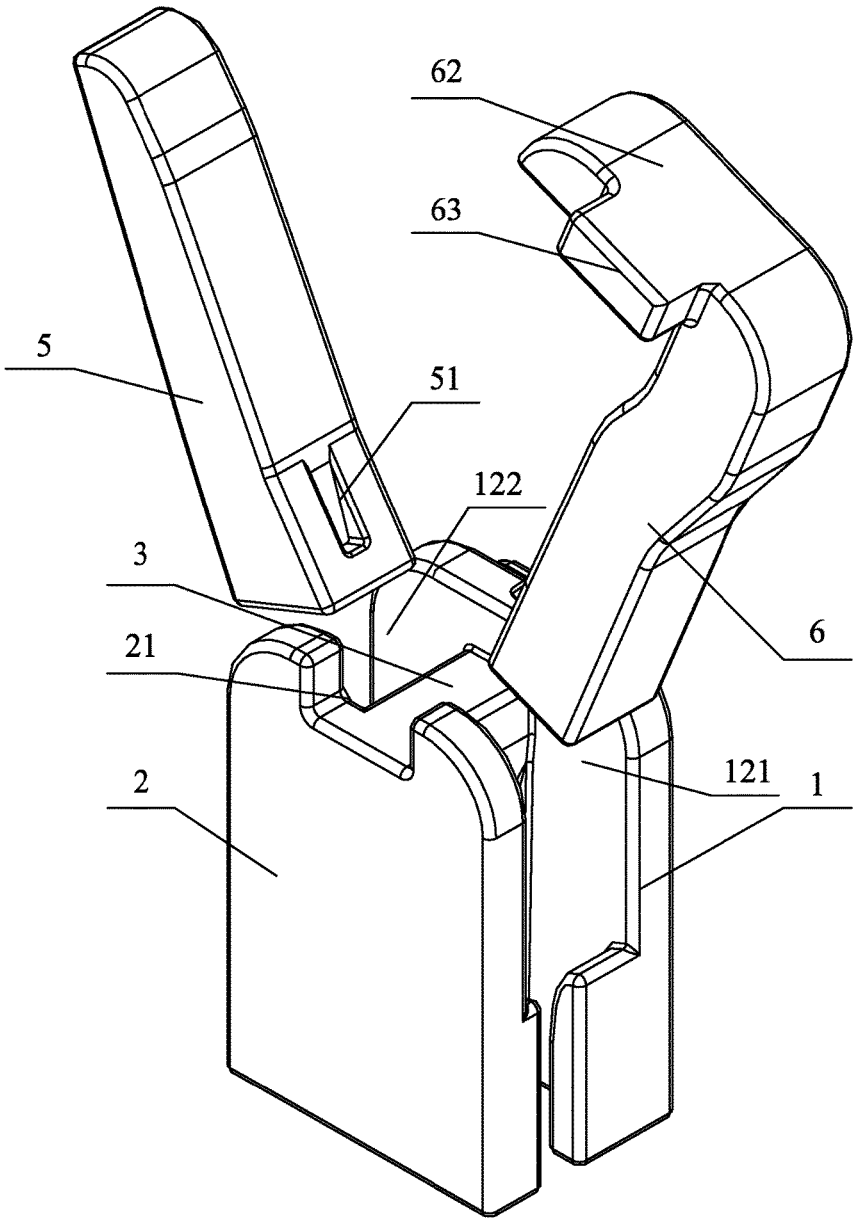
FIG. 1 is an exploded view of a retaining box for a zipper and stops according to an embodiment of the present application.
Figure 2:
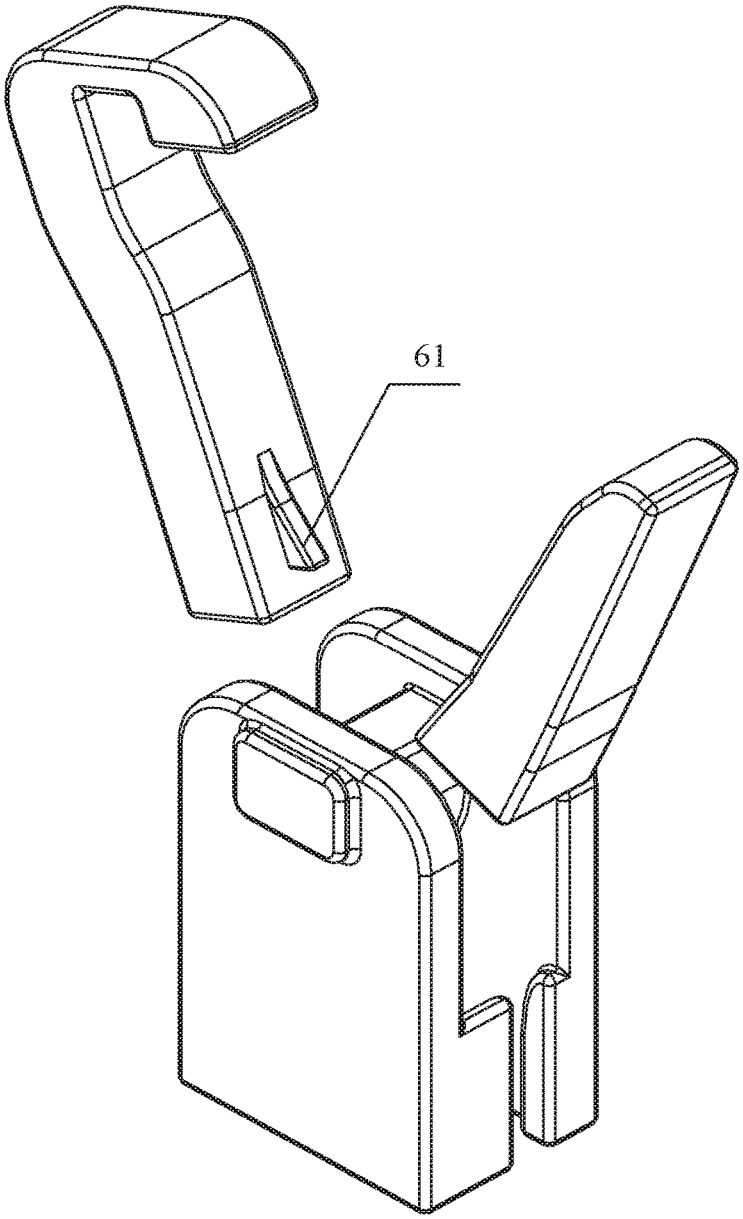
FIG. 2 is an exploded view of a retaining box for a zipper and stops according another embodiment of the present application.
Figure 3:
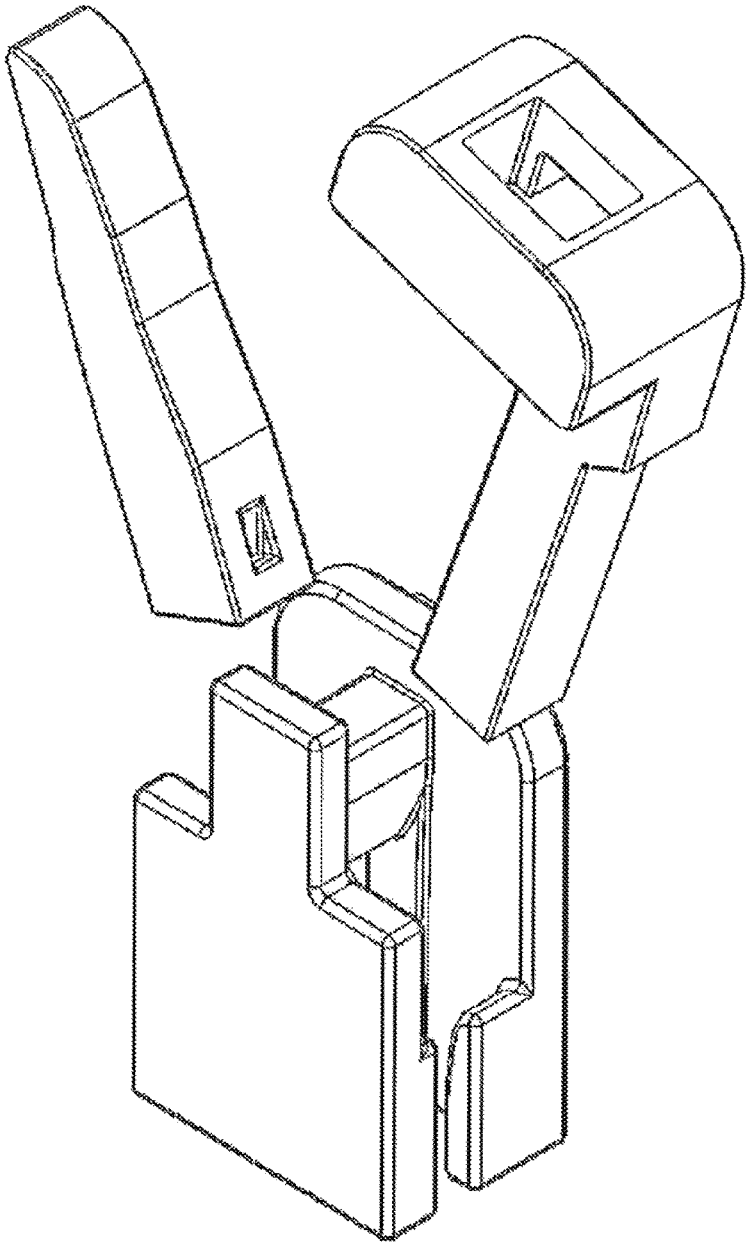
FIG. 3 is an exploded view of a retaining box for a zipper and stops according to yet another embodiment of the present application.

Referring to FIGS. 1 to 3, FIG. 1 is an exploded view of a retaining box for a zipper and stops according to an embodiment of the present application; FIG. 2 is an exploded view of a retaining box for a zipper and stops according to another embodiment of the present application; and FIG. 3 is an exploded view of a retaining box for a zipper and stops according to yet another embodiment of the present application.

The retaining box for the zipper according to the present application includes an upper panel 1, a lower panel 2, and a connecting brace 3.

The lower panel 2 and the upper panel 1 are arranged oppositely to each other, and a space for inserting therein a left stop 6 and a right stop 5 and zipper tapes is formed between the lower panel 2 and the upper panel 1.

The connecting brace 3 connects the upper panel 1 and the lower panel 2, and a first insertion opening in cooperation with a left stop 6 and a right stop 5 is provided at one end away from the connecting brace 3 of the upper panel 1 and one end away from the connecting brace 3 of the lower panel 2, and a second insertion opening in cooperation with the left stop 6 and the right stop 5 is provided at another end of the upper panel 1 and another end of the lower panel 2, and the connecting brace 3 divides the second insertion opening into a left insertion opening in cooperation with the left stop 6 and a right insertion opening in cooperation with the right stop 5.

The retaining box for the zipper according to the present application is designed to have the upper panel and the lower panel and be provided with the connecting brace 3 between the upper panel and the low panel, thus the retaining box for the zipper is designed to have the function of a slider, however, still have an effect of the retaining box in appearance according to the present application. The retaining box for the zipper according to the present application has the function of the slider and the appearance effect of the retaining box, hence the retaining box is slidable upwards and downwards along the zipper tapes. In the case that the retaining box for the zipper is employed in the zipper, the zipper may he still used as a zipper with a single open end when the retaining box is not pulled on the basis of achieving a zipper having double open ends.

Further, for improving the smoothness of sliding of the retaining box for the zipper, the connecting brace 3 according to the present application is configured to have a cross-sectional width at an end facing towards the first insertion opening smaller than a cross-sectional width at the other end.

The zipper according to the embodiment of the present application includes a left zipper tape, aright zipper tape, and a slider in cooperation with the left zipper tape and the right zipper tape. The left zipper tape is provided with a left stop 6, and the right zipper tape is provided with a right stop 5. Specifically, the slider is the retaining box for a zipper described in the above embodiment. For a zipper having two sliders, one of the sliders is designed as the retaining box for a zipper according to the above embodiment. The zipper according to the present application has the above technical effects due to employing the above retaining box, i.e., the zipper may be employed as a zipper with double open ends (the retaining box is employed as a slider), and may also be employed as a zipper with a single open end (the retaining box is employed as a retaining box).

Further, the left stop 6 has a cap end 62 at the top configured to close the right insertion opening and the left insertion opening. The lower panel 2 is provided with a position-limiting groove 21 in cooperation with a position-limiting protrusion 63 of the cap end 62. With the cooperation between the position-limiting protrusion 63 and the position-limiting groove 21, the retaining box for the zipper according to the present application may be prevented from falling off from the left stop 6.

Further, the cap end 62 has a shape fitting a shape of an outer side edge of an opening end of the second insertion opening. In the case that the retaining box of the zipper is pulled to a limit position, the left stop 6 cooperates with the retaining box, and since the shape of the cap end 62 of the left stop 6 fits the shape of the outer side edge of the opening end of the second insertion opening, the cooperation between the two is aesthetical in an appearance visual effect.

Further, a surface of the left stop 6 facing towards the right stop 5 is provided with a first mating member 61, and a surface of the right stop 5 facing towards the left stop 6 is provided with a second mating member 51 mated with the first mating member 61 in concave and convex form. In the case that the retaining box is pulled to a limit position, the first mating member 61 and the second mating member 51 are just mated, thus avoiding the shaking of the left stop 6 towards the right stop 5 in the retaining box, and improving the stability of cooperation.

In an embodiment of the present application, the first mating member 61 is a convex, and the second mating member 51 a concave. Apparently, the first mating member 61 may also be a concave, and the second mating member 51 may be a convex.

Figure 4:
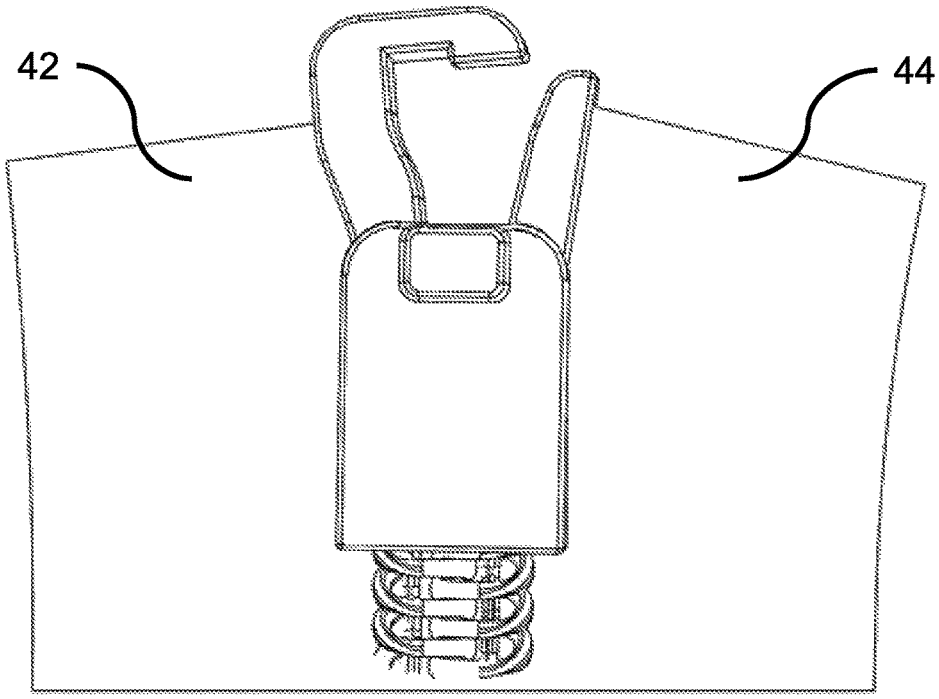
FIG. 4 shows a left zipper tape and a right zipper tape.

FIG. 4 is a view of a retaining box for a zipper and stops. As illustrated, the zipper may include a left zipper tape 42, a right zipper tape 44, and a slider in cooperation with the left zipper tape 42 and the right zipper tape 44.

Figure 5:
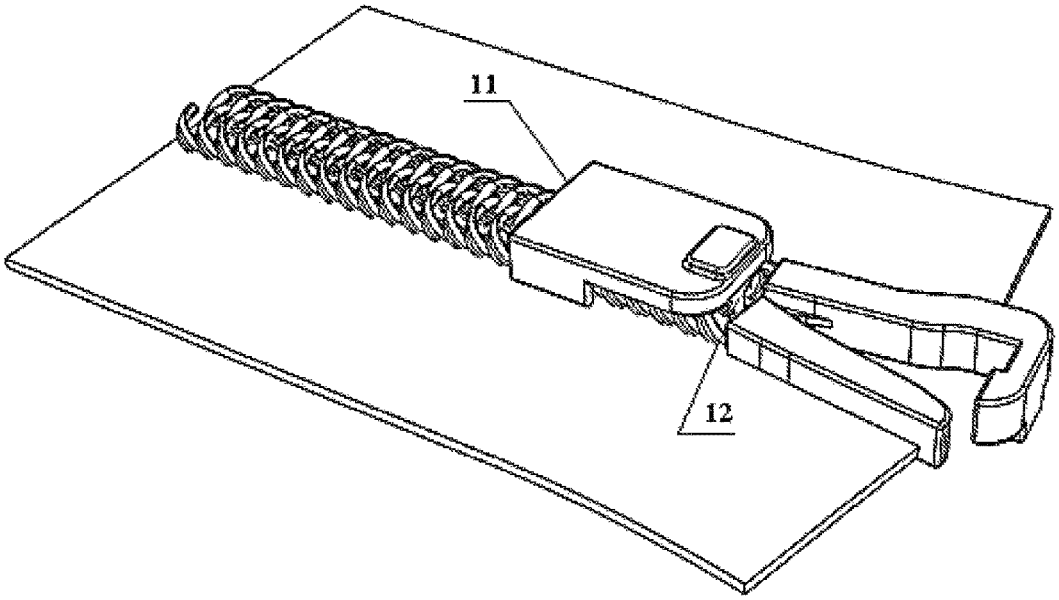
FIG. 5 shows a first insertion opening and the second insertion opening, and a left insertion opening and a right insertion opening.
Figure 6:
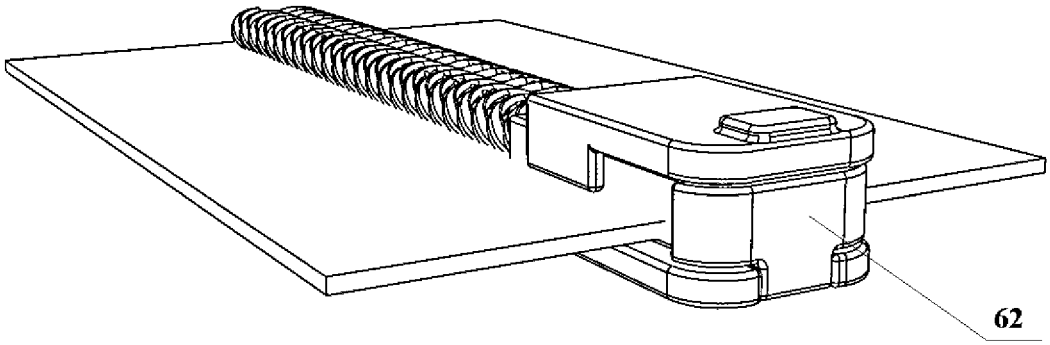
FIG. 6 shows that a left stop has a cap end at a top configured to close over the right insertion opening and the left insertion opening.

FIG. 5 is a perspective view of a retaining box for a zipper and stops and illustrates a first insertion opening 11 and a second insertion opening 12.

The above embodiments are described in a progressive manner. Each of the embodiments is mainly focused on describing its differences from other embodiments, and references may be made among these embodiments with respect to the same or similar portions among these embodiments Based on the above description of the disclosed embodiments, the person skilled in the art may carry out or use the present application. It is apparent that those skilled in the art may make many modifications to the embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

The invention claimed is:

1. A zipper, comprising a left zipper tape, a right zipper tape, and a slider in cooperation with the left zipper tape and the right zipper tape, wherein the left zipper tape is provided with a left stop, and the right zipper tape is provided with a right stop, wherein the slider comprises:

an upper panel;

a lower panel arranged oppositely to the upper panel; and a connecting brace configured to connect the upper panel and the lower panel, wherein a first insertion opening in cooperation with the left stop and the right stop is provided at one end away from the connecting brace of the upper panel and one end away from the connecting brace of the lower panel, and a second insertion opening in cooperation with the left stop and the right stop is provided at another end of the upper panel and another end of the lower panel, and the connecting brace divides the second insertion opening into a left insertion opening in cooperation with the left stop and a right insertion opening in cooperation with the right stop, wherein the left stop has a cap end at a top configured to close over the right insertion opening and the left insertion opening, wherein the lower panel is provided with a position-limiting groove in cooperation with a position-limiting protrusion of the cap end.

2. The zipper according to claim 1, wherein the cap end has a shape fitting with a shape of an outer side edge of an opening end of the second insertion opening.

3. The zipper according to claim 1, wherein a surface of the left stop facing towards the right stop is provided with a first mating member; and a surface of the right stop facing towards the left stop is provided with a second mating member mated the first mating member in a concave and convex form.

4. The zipper according to claim 3, wherein the first mating member is a convex, and the second mating member a concave.

* * * * *